United States Patent [19]

Horrigan

[11] Patent Number: 4,502,265

[45] Date of Patent: Mar. 5, 1985

[54] BREAKAWAY SAFETY HALTER

[76] Inventor: Richard Horrigan, Stormfield, Rte. 107, West Redding, Conn. 06896

[21] Appl. No.: 569,130

[22] Filed: Jan. 9, 1984

[51] Int. Cl.[3] ..... B68B 1/02

[52] U.S. Cl. ..... 54/24

[58] Field of Search ..... 54/24; 119/96, 106

[56] References Cited

U.S. PATENT DOCUMENTS

| | | | |
|---|---|---|---|
| 3,605,384 | 9/1971 | Pacini | 54/24 |
| 4,094,131 | 6/1978 | McElvey | 54/24 |
| 4,135,348 | 1/1979 | Matthews | 54/24 |
| 4,376,366 | 3/1983 | Miller | 54/24 |

*Primary Examiner*—Hugh R. Chamblee

*Attorney, Agent, or Firm*—H. Gibner Lehmann; K. Gibner Lehmann

[57] ABSTRACT

A breakaway halter for horses and like animals, comprises nose and neck straps connected by a pair of face straps. The neck strap has a pair of free end portions overlying one another in contiguous juxtaposition and secured to each other by stress-releasable means such as hook-and-loop fabric strips. Upon experiencing undue excessive longitudinal tensile separating force the free end portions of the neck strap can separate to free the animal. Cooperable with the free end portions of the neck strap is a manually-releasable fastener adapted to over-ride the stress-releasable means whereby the latter can be rendered inoperable in its function to release the halter when this is desired. The manually releasable fastener can have the form of a ring and a cooperable hook assemblage which latter includes a resilient locking blade that can be easily actuated by an attendant or other authorized person.

5 Claims, 4 Drawing Figures

BREAKAWAY SAFETY HALTER

BACKGROUND

Cross References To Related Applications

Copending application of Richard Horrigan, U.S. Ser. No. 388,802 filed June 16, 1982 and entitled SAFETY RELEASE PET COLLAR, now allowed and issuing on Jan. 24, 1984 as U.S. Pat. No. 4,426,957.

This invention relates to halters for horses and like animals, and more particularly to safety or breakaway halters that are intended to automatically release the animal in the event that the halter becomes caught or snagged on a tree or branch, or other object.

In the above-identified copending application there is disclosed a safety release dog collar comprising a neck strap having a pair of free ends which are located closely adjacent each other and provided with stress-releasable means in the form of hook-and-loop fabric strips so arranged that, should the collar become snagged on a branch or other object, the free ends can separate in response to a predetermined tensile force thereon so as to release the animal, unharmed. The free ends also carry rings in loop portions thereof, which rings are engageable by a clasp in a manner to over-ride the stress-releasable means and prevent operation or separation of the same and the consequent opening of the collar. The clasp could be at the end of a leash, whereby the collar can serve for walking or exercising the dog without its inadvertently opening and freeing the animal. Such arrangement has been found to be extremely satisfactory, and in consequence the safety dog collar of the identified copending application has had good acceptance on the part of the public.

A prior patent which discloses a breakaway horse halter is that issued to E. Pacini under U.S. Pat. No. 3,605,384 dated Sept. 20, 1971. This patent reveals a halter wherein the neck strap has a pair of free end portions overlying one another in contiguous juxtaposition and secured together by a stress-releasable means in the form of hook-and-loop fabric strips. Upon the halter experiencing undue and excessive longitudinal tensile forces as due to its being snagged or caught on a tree limb or other object, the free ends of the neck strap will part due to separation of the hook-and-loop fabric strips from one another. The halter will then free the horse, so that the animal can escape injury.

A drawback of this prior breakaway halter resides in the fact that no positive control of the animal can be had, in the event that such is desired by a trainer, owner or other authorized person, since any appreciable restraint placed by such person on the halter could result in the latter becoming released, undesirably freeing the animal. Moreover, it is not apparent how any supplemental fastener could be readily utilized with the hook-and-loop fabric strips of the patent to overcome this problem, and indeed the patentee appears to have never contemplated the problem nor its solution, insofar as the disclosure of the patent is concerned.

To my knowledge no one, prior to the present invention, has provided a safety-release halter for horses and like animals wherein the automatic release means can be easily and quickly rendered inoperative at will, as desired by the owner or trainer or other person, so that the normal restraint provided by a conventional halter is had. Under certain circumstances such normal restraint is essential, as when the horse becomes frightened or unruly for one reason or another.

In the prior patented breakaway halter the normal flexibility of the neck strap is advantageously preserved by the use of fabric strips of the hook-and-loop variety to constitute the stress-releasable means. This general characteristic of all good halters, i.e. flexibility, is considered to be extremely important to owners and trainers, since the comfort of the animal is involved, and this often has a bearing on its disposition. Moreover, for a rider, gentle horses are often preferred, or those who are at ease generally and not bothered by accouterments that fit poorly or can irritate. Prior devices intended to be worn by a horse or like animal, which can cause discomfort and injury, are not considered to be acceptable for general use.

SUMMARY

The above disadvantages and drawbacks of prior halters for horses and like animals are obviated by the present invention, which has for one object the provision of an improved, quickly convertible combination safety release and control halter that can function either to automatically release the animal in the event of accident or else to fully restrain the animal in the manner of a non-releasable halter, according to the desires of the attendant.

Another object of the invention is to provide an improved safety-release halter as above set forth, wherein a flexible stress-release device is provided in the neck strap thereof in conjunction with a manually-operable over-ride fastener that can be quickly and readily actuated to render the stress-release device inoperative at the will of the attendant.

Still another object of the invention is to provide an improved safety-release halter in accordance with the foregoing, wherein a stress-release device in the neck strap has an override means to render it inoperative, said means imposing the least possible lateral restraint on the flexibility of the neck strap so as to eliminate any possible discomfort to the animal while at the same time having a strong and reliable over-ride action.

A feature of the invention resides in the provision of an improved over-ride means in a safety-release halter as above outlined, which means is especially simple in its construction and inexpensive to produce.

Another feature of the invention resides in the provision of a novel fastener-type over-ride means for a stress-release device in a halter of the kind indicated, wherein the operation of the over-ride means is easily understood and readily carried out, without requiring skills of any kind whatsoever.

Yet another feature of the invention is the provision of a simple over-ride means for a stress-release device as described above, which is reliable in its operation and not likely to malfunction at any time.

The above objects are accomplished by a halter construction comprising a nose strap, a neck strap and a pair of face straps connecting the neck and nose straps to each other. The neck strap has a pair of free end portions overlying one another in contiguous juxtaposition, said end portions having cooperable stress-releasable means in the form of hook-and-loop fabric strips adapted to secure the end portions against inadvertent separation but failing in such securement when excessive tensile forces are encountered. The said end portions of the neck strap are each provided with loop formations, one such formation carrying a ring and the other carrying a fastener in the form of a hook and resilient blade assemblage, which is adapted to be secured to the ring in a manner to prevent separating movement of the loop formations. The fastener is easily manually operable by either hooking the hook and blade assemblage to the ring, or else unhooking it from the ring, and the resilient blade component serves as a safety lock, preventing inadvertent unhooking action of the fastener unless the blade is first depressed. The stress-releasable means comprising the joined hook-and-loop fabric strips passes through the ring that forms part of the over-ride fastener, and the entire structure retains a desirable flexibility while at the same time functioning in a reliable manner to maintain control of the horse.

Other features and advantages will hereinafter appear.

In the accompanying drawings, showing one embodiment of the invention:

Figure 1:
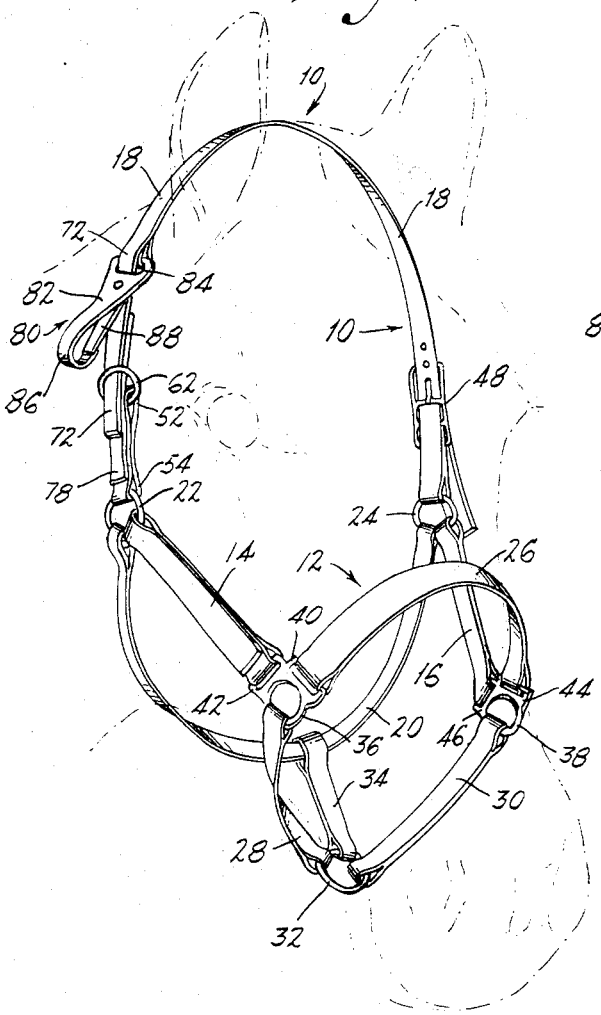
FIG. 1 is a perspective view of the improved safety-release halter for a horse, the head portion of the animal being shown in broken lines.

The combination safety-release and control halter of the invention as shown in FIG. 1 comprises a neck strap generally designated by the numeral 10 and a nose strap designated by the numeral 12, said straps being connected together by a pair of oppositely-disposed face straps 14 and 16.

The neck strap 10 comprises an upper portion 18 and a lower portion 20, these being joined respectively by a pair of rings 22, 24. In a somewhat like manner, the nose strap 12 comprises an upper portion 26 fitting across the bridge of the nose, and a pair of lower portions 28, 30 which are joined under the mouth of the horse by a ring 32. A short jaw strap 34 is connected to the ring 32 and has a loop portion encircling the center of the lower neck strap portion 20, which underlies the head and neck of the animal.

The two lower portions 28, 30 of the nose strap 12 are connected to the upper portion 26 by rings 36 and 38 each of which has a pair of straight, right-angled disposed connector sections 40, 42 and 44, 46 respectively. The upper nose strap portion 26 has loops which are accommodated respectively in the connector sections 40, 44. The face straps 14, 16 have loop portions which are respectively accommodated in the connector sections 42, 46 of the rings 36, 38, and have other loop portions which are respectively accommodated in the rings 22 and 24. The upper neck strap 18 includes a buckle arrangement 48 having a loop portion that is accommodated in the ring 24.

The foregoing is a usual construction of halters for horses, such halters being made of flexible material such as leather or woven strips of plastic or other materials.

In accordance with the present invention the improved halter hereof can be both a safety-release and a control halter, and in effecting this the upper neck strap 18 is provided with a stress-releasable means and a cooperable over-riding manually releasable fastener, all for the purpose of enabling the halter to be automatically released in the event that it becomes snagged on a tree, limb or other object so as to prevent injury to the horse, while at the same time permitting such release means to be rendered inoperable at the will of an attendant or other authorized person when such is desired. While such means and fastener are shown and described as being in the upper portion 18 of the neck strap 10 it should be understood that the invention is not limited to such specific location and that any other location on the neck strap found to be desirable, can come within the scope of the invention.

Figure 2:
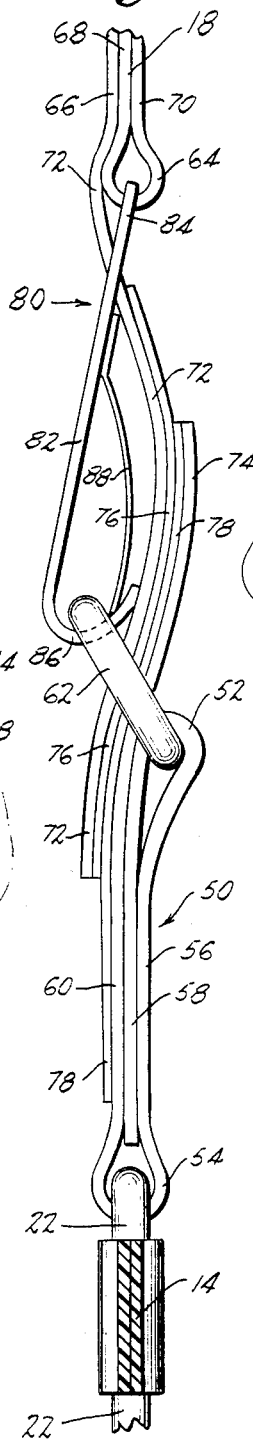
FIG. 2 is a fragmentary elevation of part of the neck strap of the halter, revealing the stress-release means and manually operable over-ride fastener therefor. The over-ride fastener is shown in its operative position.
Figure 3:
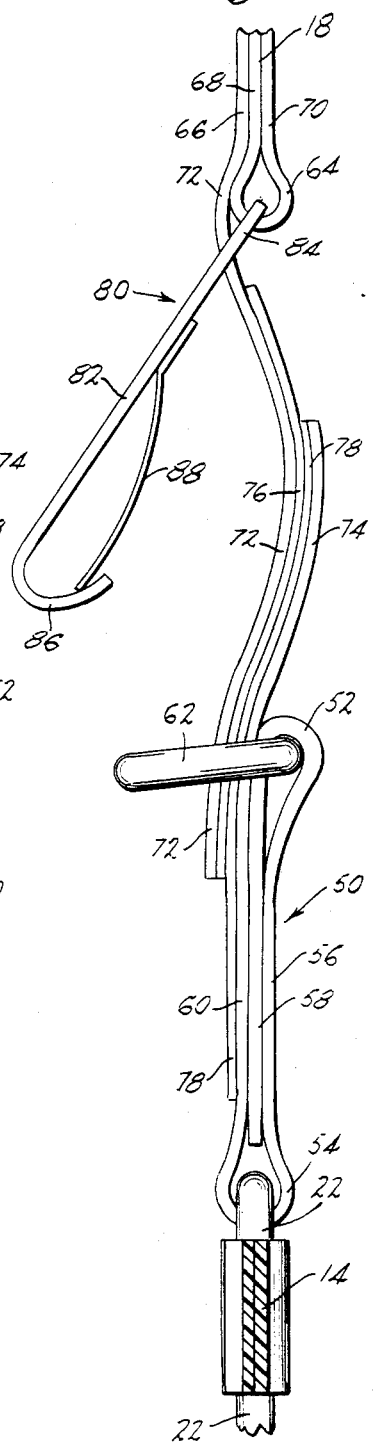
FIG. 3 is a view like that of FIG. 2 but showing the over-ride fastener in the inoperative position.

Referring now to FIGS. 1–3, the upper portion 18 of the neck strap 12 comprises a strap member designated generally by the numeral 50, such member having a pair of loops 52 and 54 which are formed by folding the member twice, resulting in three thicknesses or plies of material, designated 56, 58 and 60. The member 50 can be stitched after folding, to retain the desired shape. It will be seen that the ring 22 is accommodated in the loop 54. Also, according to the invention, a ring 62 is provided, accommodated in the loop 52.

The upper portion 18 of the neck strap 10 has a second folded-back portion forming a loop 64, said second folded-back portion comprising three thicknesses or plies of material designated 66, 68 and 70 which can also be stitched to retain the desired configuration.

In addition, the upper portion 18 of the neck strap 10 has free end portions 72 and 74 which overlie one another in contiguous juxtaposition. The free end portions 72 and 74 have facings of cooperable flexible hook-and-loop fabric fastener strips 76 and 78 which are adapted to overlap and adhere to one another; these may be made of material known commercially by the registered trade-mark "Velcro".

With the above construction the upper portion 18 of the neck strap 10 is provided with a stress-releasable means which secures the free end portions to each other and which can release or separate from each other in response to excessive longitudinal forces, such as forces in the neighborhood of 30 pounds or so. The stress-releasable means constitute a first, tensile-force responsive, releasable connection between the end portions 72 and 74. The exact amount of force required to effect the release is determined in part by the extent of overlay or overlap of the strips 76 and 78, as can be understood. If the overlay is greater, the force required to effect the release will be greater, and vice versa.

Further, in accordance with the invention, a simple manually releasable fastener is provided to effect an over-ride of the stress-releasable means whereby, at the will of the attendant or other authorized person, the stress-release means can be rendered inoperative. This is extremely important since in many cases it is necessary to retain control of a horse or other animal, irrespective of other influences.

The manually-releasable fastener provided by the invention is at once extremely simple and effective, yet it does not add to the stiffness or discomfort of the halter. Moreover, while being rugged and dependable it can be easily and quickly operated, either to its released position or to its active position so as to render the stress-release means either operative or else inoperative respectively.

As shown, the manually releasable over-ride fastener comprises the ring 62 and also a hook and resilient blade assemblage designated generally by the numeral 80. Such assemblage comprises a hook member 82 having an apertured portion 84 accommodated in the loop 64 of the neck strap, and a bill portion 86 adapted to pass through the ring 62. A resilient metal blade 88 secured to the hook member 82 engages the inside of the bill portion 86 and locks the hook member to the ring when in its operative position, as seen in FIG. 2. By depressing the blade 88, however, the hook member 82 can be easily disengaged from the ring 62, this being shown in FIG. 3. When the hook member 82 and ring 62 are attached, they constitute a second connection between the end portions 72 and 74, this second connection being not subject to release by tensile force, and being generally coextensive with the connection formed by the hook-and-loop fastener strips 76 and 78. In addition, this assemblage of hook member 82 and ring 62 is seen to bridge the area of overlap of the hook-and-loop fastener strips.

Figure 4:
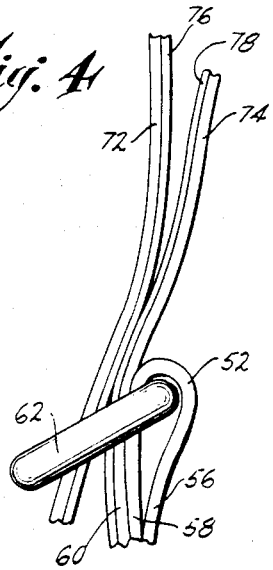
FIG. 4 is a fragmentary view indicating the separating action of the stress-release means.

The automatic-release position of the halter is as shown in FIG. 3, wherein the hook member 82 is disengaged from the ring 62. If, now, an excessive longitudinal tensile force occurs in the neck strap 10, the hook-and-loop fastener strips 76 and 78 will separate, as seen in FIG. 4, whereupon the neck strap 10 of the halter will become open and release the animal. Such action can occur if the halter becomes caught or snagged on a tree or limb, or other object.

As will be now understood, when the manually-operable fastener 62, 82 is in its operative position of FIG. 2, the halter cannot automatically separate and free the animal. Thus, a positive control of the animal is had for this condition.

It will now be seen from the foregoing that I have provided a novel and improved combination safety halter which is quickly convertible from the safety phase to the control phase and vice versa, as desired. The combination of stress-releasable means and manually-operable fastener does not stiffen or otherwise adversely affect the comfort of the halter, nor increase the cost appreciably; moreover, it greatly enhances the utility of the device, as can now be understood. The manually-operable fastener is simple to operate, requiring no special skills or strength. It is visual, and its functioning or operability can be ascertained at a glance. The device is small and unobtrusive, and is well accommodated on the halter. It represents a distinct advance and improvement in the field of halters for horses and like animals, and the wearing of the improved safety release and control halter does not result in any more discomfort to the animal than the wearing of a conventional halter.

Each and every one of the appended claims should be considered in its entirety and apart from a consideration solely of the main or parent claim, since each claim represents a concept separate and apart from the others.

Variations and modifications are possible without departing from the spirit of the invention.

I claim:

1. A breakaway halter for horses and like animals, comprising in combination:

(a) a nose strap, (b) a neck strap, (c) a pair of face straps connecting the nose strap to the neck strap, (d) said neck strap having a pair of free end portions overlying one another in contiguous juxtaposition, (e) an elongate, overlapping stress-releasable means on said free end portions of the neck strap, said means having areas disposed broadside to each other, said stress-releasable means securing together said free end portions of the neck strap and being adapted to separate and enable separation of said free end portions when the latter are subjected to a given tensile separating force, and (f) a manually-releasable positive fastener means comprising a ring permanently and securely attached to one of said free end portions of the neck strap and encircling the said broadside areas of the elongate, overlapping stress-releasable means to facilitate alignment thereof, said stress-releasable means extending through said ring and being operable to hold the halter together without dependence on said ring, and said fastener means being adapted to secure the said free end portions of the neck strap to each other against inadvertent separation, (g) said manually-releasable positive fastener means normally applying pressure to the overlapping stress-releasable means to increase the holding power thereof, said positive fastener means overriding and rendering inoperative the separation of the stress-releasable means so as to prevent separation of the free end portions of the neck strap if the latter should experience longitudinal tensile separating force in excess of that given force for which the stress-releasable means is operable.

2. A break-away halter as set forth in claim 1, wherein:

(a) said manually-releasable positive fastener means further comprises a hook and resilient blade assemblage carried by the other of said free end portions of the neck strap and cooperable with said ring for securement to and removal from the same.

3. A breakaway halter as set forth in claim 1, wherein:

(a) the stress-releasable means comprises a pair of cooperable, flexible hook-and-loop fastener strips secured respectively to said free end portions of the neck strap.

4. A halter as set forth in claim 3, wherein:

(a) one free end portion of the neck strap has a loop, (b) the ring of the said manually-releasable fastener means passing through said loop, and (c) one of the fastener strips of the stress-releasable means is secured to the loop of the said free end portion and passes through said ring.

5. A break-away halter as set forth in claim 4, wherein:

(a) the other of said free end portions of the neck strap has a loop, (b) said manually-releasable fastener means comprising a hook and resilient blade assemblage attached to the loop of said other of the free end portions.

* * * * *